US006283831B1

(12) United States Patent
Fischer et al.

(10) Patent No.: US 6,283,831 B1
(45) Date of Patent: Sep. 4, 2001

(54) METHOD FOR DESANDING CASTINGS

(75) Inventors: Kurt Fischer; Hans Leutwiler, both of Schaffhausen (CH)

(73) Assignee: Georg Fischer DISA AG, Schaffhausen (CH)

( * ) Notice: Subject to any disclaimer, the term of this patent is extended or adjusted under 35 U.S.C. 154(b) by 0 days.

(21) Appl. No.: 09/413,470

(22) Filed: Oct. 6, 1999

(30) Foreign Application Priority Data

Oct. 6, 1998 (DE) ..... 198 45 899

(51) Int. Cl.[7] ..... B24B 1/00
(52) U.S. Cl. ..... 451/28; 451/36
(58) Field of Search ..... 134/6, 7, 11, 31, 134/36, 2, 42, 22.1, 22.18, 21; 15/316.1; 451/28, 29, 30, 32, 104, 113, 114

(56) References Cited

U.S. PATENT DOCUMENTS 4,074,858 * 2/1978 Burns et al. ..... 239/172
4,303,453 * 12/1981 Jung et al. ..... 134/10

* cited by examiner

*Primary Examiner*—Derris H. Banks
(74) *Attorney, Agent, or Firm*—Antonelli, Terry, Stout & Kraus, LLP

(57) ABSTRACT

For desanding castings cast in moulding sand by means of at least one fluid pressure pulse acting on the sand mould, the fluid is bundled into at least one cutting jet and the latter is made to act directly on the sand mould.

25 Claims, 3 Drawing Sheets

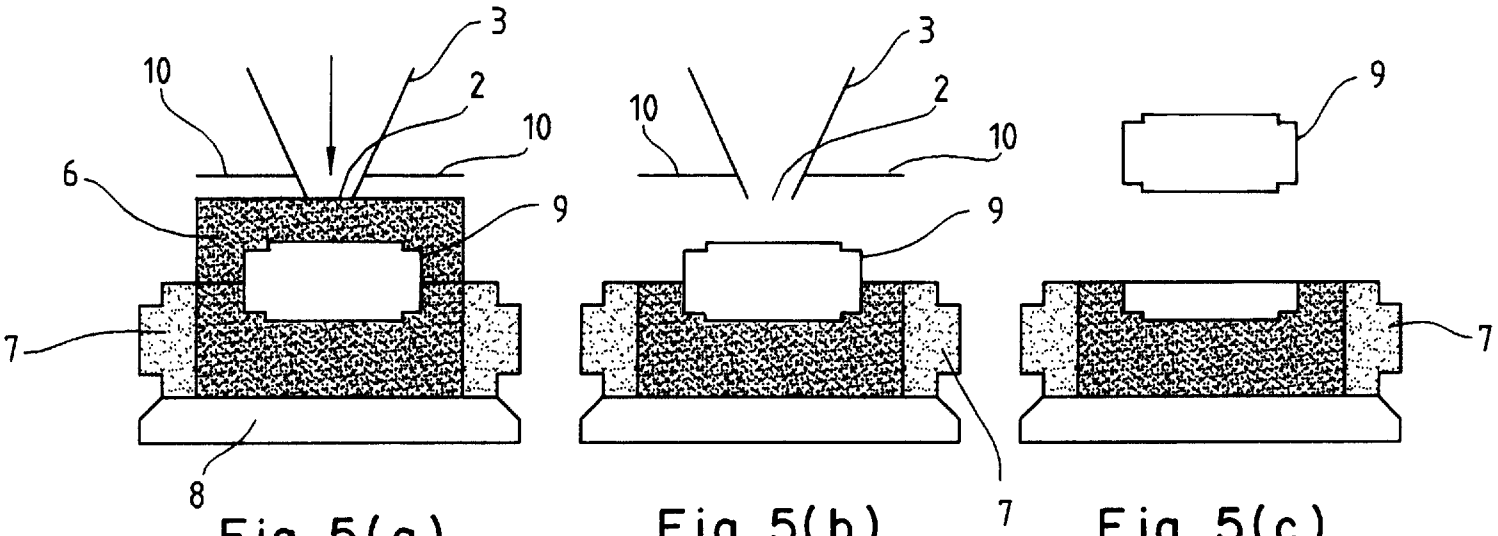
Fig. 5(a)
Fig. 5(b)
Fig. 5(c)
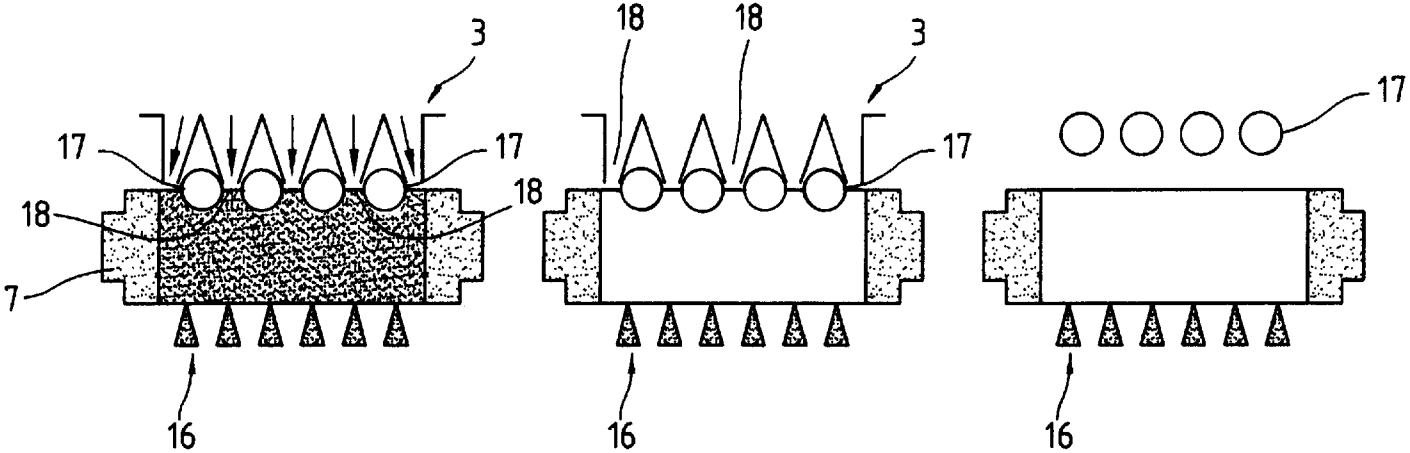
Fig. 6(a)
Fig. 6(b)
Fig. 6(c)

METHOD FOR DESANDING CASTINGS

BACKGROUND OF THE INVENTION

The invention relates to a method for desanding or removing sand from castings cast in moulding sand by means of at least one fluid pressure pulse acting on the sand mould.

In modern foundry technology the manufacture of the sand mould for box-linked or boxless casting and the subsequent casting has been improved to a high technological state. However, this does not apply with respect to the finishing of the castings, particularly the preliminary desanding and desanding of the castings. To the extent that these are mechanical processes, the mould body, optionally together with the mould box, is vibrated, rolled or pounded, which is on the one hand associated with relatively high energy costs and on the other with considerable noise emission. In addition, the order state of the castings in the mould body is broken up and the castings pass into uncontrolled positions, which through the feeder and riser present at the casting extend to complicated confused layers. It is then virtually impossible to handle them with automated equipment, so that manual action is necessary. In addition, in areas where the moulding sand has been removed from them, the castings are directly exposed to the mechanical forces and are consequently often damaged. This more particularly applies during desanding on deflecting grates, vibrating conveyors or in cooling drums.

Therefore numerous attempts have been made to substitute these mechanical desanding processes and in particular to reduce or completely avoid noise and dust emissions. Thus, inter alia, preliminary desanding by pressurized water is known, which substantially avoids noise and dust emissions. However, the considerable water requirement and the treatment of the water required by water regulations make this problematical. In addition, temperature and stress cracks can occur on the casting. These problems are avoided when desanding by compressed air pulses (DE-journal "Giessereitechnik" 1998, p 37). This method uses the same principle as for moulding machines for the manufacture of the mould. In this method hitherto only known for box casting, a hood is placed on the moulding box and by means of a rapidly opening valve a large-area compressed air blast is applied to the sand surface. This known method functions with relatively lower energy costs and reduced noise emission, whilst at the same time protecting the castings. However, this method has not hitherto been successful in practice, because the casting is only inadequately desanded.

SUMMARY OF THE INVENTION

The problem of the invention is to propose a method operating with fluid pressure pulses, which with low energy costs and low noise emissions permits a substantially complete desanding of the casting.

According to the invention this problem is solved in that the fluid is bundled or focussed into at least one cutting jet and the latter is made to act on the sand mould. For example, the cutting jet can be oriented under a steep angle to the sand mould surface. It is also possible to produce several successive fluid pressure pulses, which lead to several cutting jets acting in time succession. In addition, the cutting jet geometry, the cutting jet impact angle, as well as the pulse duration and intensity are adapted to the given circumstances (sand mould size, moulding sand height above the casting, number of castings in the mould, their hardness, etc.).

According to an embodiment the fluid can be focussed or bundled to a punctiform cutting jet and the cutting jet and casting can be moved relative to one another. Instead of this it is possible to bundle the fluid to a linear or lamellar cutting jet, the latter preferably having a length corresponding to the sand mould extension in one direction.

The cutting jet formed in accordance with the invention penetrates the moulding sand down to the casting surface and is partly reflected there and partly deflected onto the casting surface, so that the moulding sand is separated from the casting in a combined cutting and peeling movement. For small castings and small mould bodies, it is generally sufficient to have a single cutting jet, whereas for large or large-volume castings or mould bodies formed from multiple moulds simultaneously several cutting jets are made to act on the sand surface. This can take place in stationary manner or the cutting jet and mould body are moved relative to one another. The movement direction can be matched to the given mould body or casting contour.

The fluid can be a gas or a liquid and can also contain solid particles. The main fluid used is compressed air and this is available in any foundry. However, preference is given to the use of a compressed air-particle mixture, which reinforces the cutting action. The particulate component is in particular sand, particularly the dry moulding sand obtained on shaking out, because this can be processed together with the moulding sand obtained during desanding for the moulding shop.

In the method according to the invention there is only a surface desanding of the casting, whereas the mould cores remain in the casting. They can be subsequently separated, so that the mould material essentially does not pass into the moulding sand and contaminate the latter and can instead be processed separately.

In the case of multiple moulds with identical or similar castings, which are spaced in a single mould body, the cutting jet is preferably oriented on the gaps between the castings and the moulding sand located there is shot through.

Also in the case of castings which do not have linear, but instead moulding sand-filled contours on projection into the sand mould position plane, it is advantageous to orient the cutting jet with the casting-free moulding sand areas.

The inventive method also offers the advantageous possibility of exposing the castings with the adhering moulding sand to the cutting jet in the position assumed during casting.

After desanding the castings are essentially in the same controlled position assumed in the mould body. From said order state the castings can be easily handled or conveyed into clearly defined positions.

The method according to the invention can be used both in box casting and boxless casting. In the case of box-linked moulds preferably the upper box is drawn off prior to desanding and the projecting mould body is exposed to the cutting jet.

BRIEF DESCRIPTION OF THE DRAWINGS

The invention is described in greater detail hereinafter relative to a non-limitative embodiment and the attached drawings, wherein show:

FIG. 5 A diagrammatic representation of an embodiment of the different method stages.

FIG. 6 A diagrammatic representation of another embodiment of the method.

DETAILED DESCRIPTION OF THE PREFERRED EMBODIMENTS

Figure 1:
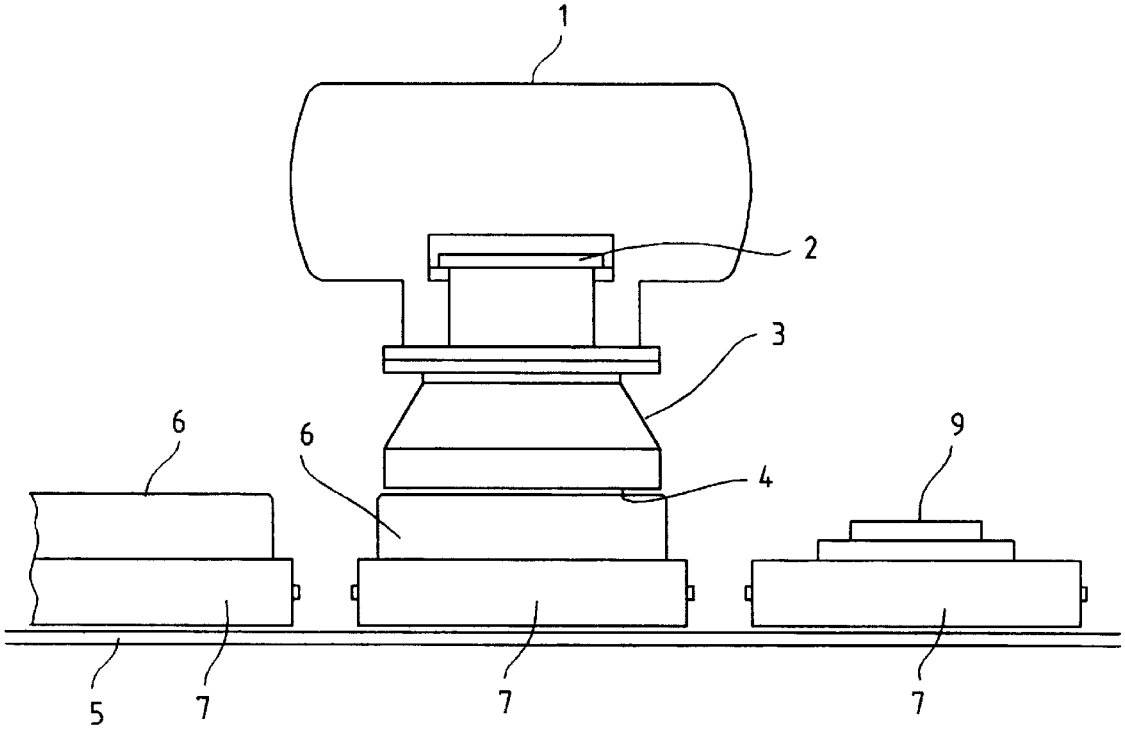
FIG. 1 A diagrammatic side view of an apparatus for performing the method.

The apparatus diagrammatically shown in FIG. 1 has a compressed air container 1 filled with compressed air by means of a compressor. The compressed air container 1 is sealed by a valve 2 opening into the container and which operates with extremely short opening times. To the valve 2 is connected an air guiding device 3, which has an air outlet on its underside 4.

In the embodiment shown in FIG. 1 the above-described apparatus is used for box casting desanding. In the case of moulding boxes delivered from the moulding machine or cooling section the upper box has already been removed, so that the mould body 6 in the lower box 7 is conveyed on the conveyor belt 5 to the apparatus. On the conveyor belt the lower box 7 passes under the compressed air container or the air guiding device 4. Following the sudden opening of the valve 2 the compressed air passes out in jet-like manner at the exit side 4, strikes the mould sand surface of the mould body 6 and cuts through the sand body down to the embedded castings. The compressed air is partly reflected on the surface of the castings, partly deflected along the surface and thereby cuts or peels the moulding sand away to the side. Optionally the compressed air jet can act by a relative displacement of the lower box 5 with respect to the air guiding device 3 on different areas of the moulding sand body until finally all the moulding sand has been hurled away to the side. The lower box 7 with the castings 9 desanded above it passes into a position in which lower box removal is possible.

Figure 2:
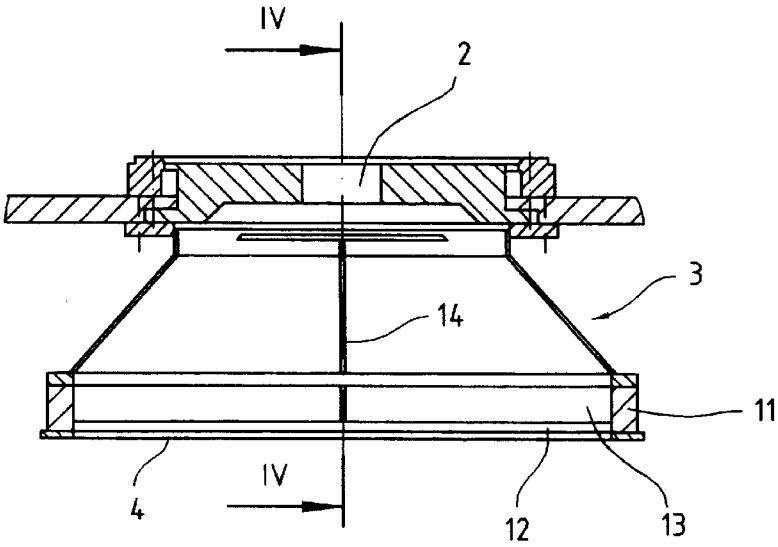
FIG. 2 A larger-scale longitudinal section through part of the apparatus.
Figure 3:
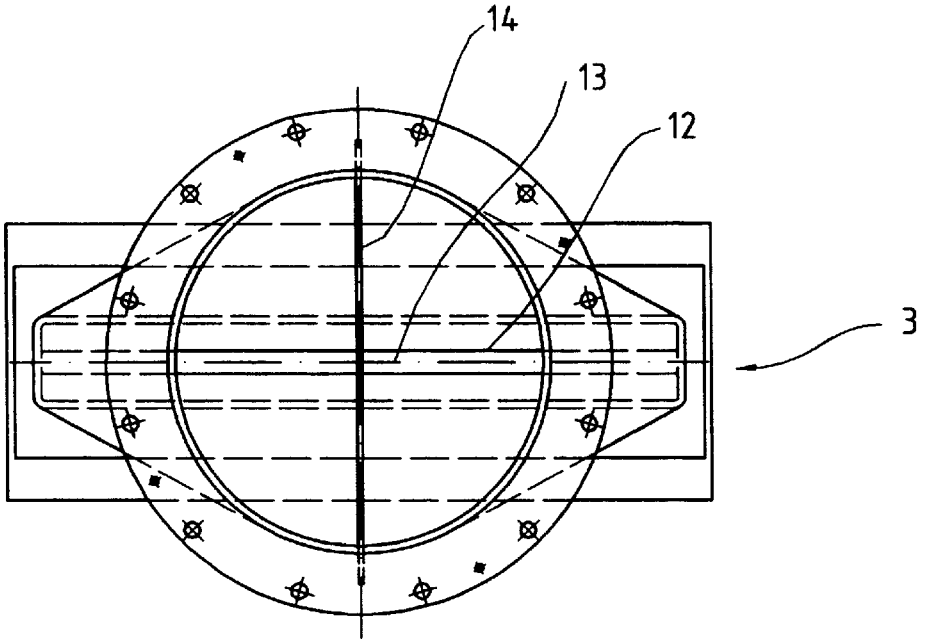
FIG. 3 A plan view of the representation according to FIG. 2.
Figure 4:
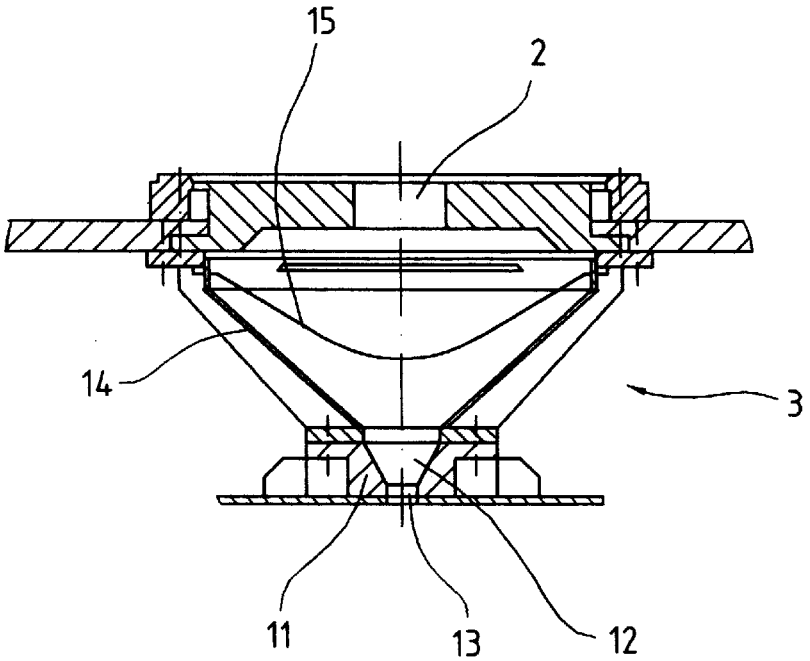
FIG. 4 A section IV—IV according to FIG. 3.

FIGS. 2 to 4 show the air guiding device 3 according to FIG. 1 in greater detail. FIG. 2 only shows the exit cross-section, to which is connected the air guiding device 3, of the valve 2 according to FIG. 1. The air guiding device 3 is constricted in the drawing plane of FIG. 2 in lunette-like manner outwards (FIG. 3), whereas in the plane perpendicular thereto it tapers in funnel-like manner (FIG. 4). The underside of the air guiding device 3 is terminated by a flange 11, which has a conical intake piece 12 and connected thereto a flat nozzle 13 (FIG. 4). As a result the compressed air passing in pulse-like manner into the air guiding device 3 is bundled into an elongated, lamellar jet, which passes out at the air exit side 4 of the air guiding device 3 and immediately after passing out strikes in blade-like manner the moulding sand body. The air guiding device 3 is centrally provided with a partition 14, whose upper edge 15 is cut back in downwardly arcuate manner below the exit cross-section of the valve 2.

FIG. 5 shows the individual stages of the method already described relative to FIG. 1. The lower box 7 rests on a closed substrate 8, e.g. a pallet. After drawing off the upper box, the upper mould body 6 is free and the lower box 7 is moved under the air guiding device (FIG. 5*a*), whose exit port in the form of a wide-slot nozzle preferably rests directly on the surface of the mould body 6. At a limited distance above the mould body 6, lateral baffle plates 12 are associated with the air guiding device 3 and they displace the exiting air, if it is reflected, to the side and consequently assist the lateral conveying away of the moulding sand. Following desanding the casting 9, to the extent that it projects into the upper box, is free (FIG. 5*b*) and can be raised out of the lower box 7 in the next station (FIG. 5*c*). In the embodiment according to FIG. 6 the lower box 7 is brought onto a permeable substrate 16, e.g. a grate. The sand mould contains several, individual castings 17, which are arranged in spaced manner in the parting plane of the sand mould. The air guiding device 3 has several nozzles 18 adapted to the number of castings, so that in each case one cutting jet is directed between the castings and between the outer castings and the mould box wall (FIG. 6*a*). After opening the valve 2 at the pressure container 1the compressed air passing out in surge-like manner blasts the moulding sand out of the lower box 7 downwards through the grate 10, the castings 17 being exposed (FIG. 6*b*). As can be gathered from FIG. 6*c*, the castings 17 maintain the predetermined order state in the mould body and in this state can be conveyed into a further finishing station or can be transferred by handling means into clearly defined positions.

What is claimed is:

1. Method for desanding castings case in moulding sand in a sand mould by means of at least one fluid pressure pulse acting on the sand mould, characterized in that the fluid is bundled to a punctiform cutting jet and the cutting jet and casting are moved relative to one another.

2. Method according to claim 1, characterized in that the cutting jet is oriented under a steep angle to the sand mould surface.

3. Method according to 1, characterized in that several cutting jets are simultaneously made to act on the sand mould surface.

4. Method according to claim 1, characterized in that the cutting jet is reflected on the sand mould or casting, and immediately after exit of the cutting jet, the cutting jet is deflected to the side by baffle plates positioned at a limited parallel distance from the sand mould surface.

5. Method according to 1, characterized in that compressed air is used as the fluid.

6. Method according to claim 1 characterized in that in the case of multiple sand moulds with castings embedded in a spaced manner in the moulding sand, the cutting jet is oriented onto the gaps between the castings.

7. Method according to claim 1 characterized in that in the case of castings which, on projecting into the position plane of the sand mould do not have linear, but instead moulding sand-filled contours, the cutting jet is oriented onto the casting-free sand mould areas.

8. Method according to claim 1, characterized in that the castings with the adhering moulding sand are exposed to the cutting jet in the position assumed on casting and after desanding maintain their position.

9. Method according to claim 1, characterized in that for desanding purposes the sand mould is placed on a permeable substrate.

10. Use of the method according to claim 1 in boxless sand moulds, characterized in that a larger surface of the mould body is exposed to the cutting jet.

11. Use of the method according to claim 1 for box moulds, characterized in that the box part at the top is removed and the projecting mould body is exposed to the cutting jet.

12. Method for desanding castings cast in moulding sand in a sand mould by means of at least one fluid pressure pulse acting on the sand mould, characterized in that the fluid is bundled to a linear or lamellar cutting jet with a length roughly corresponding to the sand mould extension in the direction, and the cutting jet is made to act directly on the sand mould.

13. Method according to 12, characterized in that the fluid contains a solid particle.

14. Method according to claim 8, characterized in that a compressed air-sand mixture is used as the fluid.

15. Method according to claim 14, characterized in that the sand used is the dry moulding sand obtained on shaking out the sand mould.

16. Method according to 12, characterized in that the cutting jet is oriented under a steep angle to the sand mould surface.

17. Method according to claim 12, characterized in that several cutting jets are simultaneously made to act on the sand mould surface.

18. Method according to claim 12, characterized in that the cutting jet is reflected on the sand mould or casting, and immediately after exit of the cutting jet, the cutting jet is deflected to the side by baffle plates positioned at a limited parallel distance from the sand mould surface.

19. Method according to claim 12, characterizsed in that compressed air is used as the fluid.

20. Method according to claim 12 characterized in that in the case of multiple sand moulds with castings embedded in a spaced manner in the moulding sand, the cutting jet is oriented onto the gaps between the castings.

21. Method according to claim 12, characterized in that in the case of castings which, on projecting into the position plane of the sand mould do not have linear, but instead moulding sand-filled contours, the cutting jet is oriented onto the casting-free sand mould areas.

22. Method according to claim 10, characterized in that the castings with the adhering moulding sand are exposed to the cutting jet in the position assumed on casting and after desanding maintain their position.

23. Method according to claim 12, characterized in that for desanding purposes the sand mould is placed on a permeable substrate.

24. Use of the method according to claim 12 in boxless sand moulds, characterized in that a larger surface of the mould body is exposed to the cutting jet.

25. Use of the method according to claim 12 for box moulds, characterized in that the box part at the top is removed and the projecting mould body is exposed to the cutting jet.

* * * * *